United States Patent [19]

Tokuda et al.

[11] Patent Number: 5,052,673

[45] Date of Patent: Oct. 1, 1991

[54] SHEET FEEDING DEVICE

[75] Inventors: Hiroshi Tokuda, Nagoya; Shigeo Ishikawa, Hazu; Toshiaki Sugiura, Hekinan; Hikaru Kaga, Ama, all of Japan

[73] Assignee: Brother Kogyo Kabushiki Kaisha, Nagoya, Japan

[21] Appl. No.: 403,759

[22] Filed: Sep. 6, 1989

[30] Foreign Application Priority Data

Sep. 9, 1988 [JP] Japan ..... 63-227089
Nov. 17, 1988 [JP] Japan ..... 63-290858

[51] Int. Cl.[5] ..... B65H 3/06

[52] U.S. Cl. ..... 271/22; 271/110; 271/117; 271/127

[58] Field of Search ..... 271/22, 110, 111, 117, 271/118, 127

[56] References Cited

U.S. PATENT DOCUMENTS 4,023,792 5/1977 Punnett ..... 271/22
4,317,138 2/1982 Bryan ..... 261/110 X
4,319,741 3/1982 Okamoto ..... 271/127 X
4,346,878 8/1982 Aizawa ..... 271/127 X
4,351,519 9/1982 Jendrick .
4,828,245 5/1989 Shimogawara .

FOREIGN PATENT DOCUMENTS 0251819 7/1987 European Pat. Off. .
0283021 3/1988 European Pat. Off. .
49-18336 2/1974 Japan .
62-150439 9/1987 Japan .

*Primary Examiner*—Richard A. Schacher
*Attorney, Agent, or Firm*—Kane, Dalsimer, Sullivan, Kurucz, Levy, Eisele and Richard

[57] ABSTRACT

A sheet feed device for feeding sheets from a stack to a machine, such as a copier, is provided with rollers for feeding the top sheet of the stack to the entrance of the machine. When a sheet is being fed through the machine, the presence of the sheet is sensed and used to generate a signal to disengage the rollers from the stack to thereby ensure precise feeding of the sheets.

16 Claims, 12 Drawing Sheets

SHEET FEEDING DEVICE

BACKGROUND OF THE INVENTION

The present invention relates to a sheet feeding device for feeding a printing sheet or copy sheet to a printing portion of a printer or copying portion of a copy machine, and more particularly, to a sheet feeding device utilizing a cassette case attachable and detachable to and from such a machine for stacking a plurality of sheets and having a function capable of controlling a pair of feed rollers for feeding the sheet located on the top of the stacked sheets so as to be brought out of contact with the surface of the sheet when the sheet is fed and the cassette is detached from the machine.

In a sheet feeding device having a cassette described above, a plurality of sheet types which differ in sheet size, sheet quality and so forth, have been housed in different cassette cases. As necessary, the cassette cases are changed to feed a desired sheet to the machine. Since this type of sheet feeding device is convenient, it has been widely used. In this cassette type, a case housing portion is provided in a machine such as a printer or copy machine. In the case housing portion, a cassette case which houses a plurality of sheets being stacked is inserted. A variety of types for sheet feeding devices having a cassette have been announced, one of which provides a pair of sheet feed rollers and separation nails desclibed below. In other words, sheet feed rollers are provided near a case housing portion. The sheet feed rollers touch the sheet located on the top of the stacked sheets and are rotatably driven, thereby forwardly feeding the sheet.

On the other hand, the cassette case is provided with a tension member for pressing the bottom side of the bottom sheet of the stacked sheets in such a manner that the top sheet is brought into contact with the sheet feed rollers. In addition, the cassette case is provided with a pair of separation nails which are located in such manner that they are touched at least from the front side and upper side to both left and right corners of the front end in a sheet feed direction of the sheet being stacked and housed in the cassette case.

When the sheet feed rollers feed the sheet, both the corners of the top sheet are bent and deformed so as to allow only the top sheet to be fed. The separation nails are supported by sheet separation portions which are movable in a direction nearly the same as that in which the paper is stacked.

The method where sheet is fed sheet by sheet using its frame is named a "paper separated and bent by nail" method.

In the paper feeder described above, when the cassette case is detached or attached, if the stacked sheet in the cassette case touches (interferes with) the sheet feed rollers in the case housing portion, some troubles such as wrinkling, bending, and deviation from a predetermined position will occur. Further, in this type of sheet feeding devices, when a sheet is sent from the sheet feed rollers to a feed mechanism sequentially located to the sheet feed rollers, the above troubles will occur if the sheet is brought into contact with the sheet feed rollers. Thus, it is necessary to prevent the sheet from touching the sheet feed rollers when the cassette case is attached and detached, until the sheet fed from the sheet feed rollers reaches the feed mechanism.

To do that, in one type of a sheet feeding device which has been devised, as shown in FIG. 1 the sheet feed rollers 106 mounted on an end of a switching arm 130 are moved between a contact position where the sheet feed rollers 106 touch the top sheet in a cassette case 102 and an escape position with a predetermined length about a support shaft 131, and the sheet feed rollers 106 are touched to the sheet only when a sheet feed operation takes place (The bottom side 104 of the bottom sheet is pressed in a vertical direction by a spring 105 as a tension member, as described before.).

In another type of a sheet feeding device, as shown in FIG. 2 a part of periphery of each sheet feed roller 206 is cut so as to form a "D" shape. In the normal state, a flat portion **206*a* is opposed to the top sheet of a sheet P in a cassette case 202 and a predetermined distance therefrom. In the sheet feed state, the arc portion of each "D" shaped roller 206 is touched to the top sheet of the sheet P so as to feed it (The bottom side 204 of the bottom sheet is pressed in a vertical direction by a spring 205** as a tension member, as dscribed before).

However, in the former structures, since a mechanism for movably supporting the sheet feed rollers 106 and drive member thereof are required, the structure will become complicated, resulting in increasing the cost of the production and possibility of troubles. In addition, although the sheet feed rollers 106 are touched to the top sheet whenever fed, the reliability of sheet feeding will not be satisfactory due to a problem of precision of the sheet feed position.

On the other hand, in the FIG. 2 structure, the home position of the sheet feed roller 206 (where the flat portion **206*d* is opposed to the top sheet) should be always controlled, resulting in increasing the cost of the production. In addition, at the arc portion of the D-shaped sheet feed roller 206, a sheet should be fed with a predetermined stroke, thereby requiring the diameters of the sheet feed rollers 206 to be large. Moreover, where two sheet feed rollers 206** on the left and right exist, if the "D" cut portions on the left and right are not equal, sheet skewing which inclinedly feeds sheet takes place.

In addition, Japanese Patent Provisional Publication No. SHO49-18336 discloses apparatus for housing a cassette in a copy machine wherein a dowel and cam plate are relatively provided in a sheet holding plate of the cassette and a cassette holder of the machine. When the cassette is attached, the dowel and the cam plate are engaged so as to push down the holding plate, thereby causing the top sheet not to touch the sheet feed rollers. When the cassette has been completely attached, the sheet touches the sheet feed rollers.

Although the above structure is simpler than those using the movable sheet feed rollers and "D" shaped rollers, just before the cassette has been attached, the sheet feed rollers may touch the top sheet, resulting in sheet trouble.

In the above structure, after the cassette is attached and the sheet is fed by the sheet feed rollers, when the sheet is fed to the feed mechanism, the sheet feed rollers always touch the sheet, resulting in affecting precision of sheet feeding by the sheet feed mechanism.

SUMMARY OF THE INVENTION

It is therefore an object of the invention to provide an improved sheet feeding device capable of controlling the stacked sheets in such a manner that the sheet located on the top of the sheets is to be brought out contact with the sheet feed rollers in case the sheet fed from the sheet feed rollers reaches the feed mechanism.

Another object of the invention to provide an improved sheet feeding device capable of controlling the stacked sheets in such a manner that the sheeet located on the top of the sheets is to be brought out of contact with the sheet feed rollers in case that the sheet fed from the sheet feed rollers reaches the feed mechanism, while to be brought into contact in case that the top sheet is to be fed.

For this purpose, according to one aspect of this invention, there is provided a sheet feeding device comprising a case member for holding a plurality of sheets in a stacked state, a pair of feed roller members loacated above the stacked sheets for feeding the sheet located on the top of the stacked sheets, and sheet feed means for further feeding the sheet fed from the pair of feed roller members, the sheet feeding device comprises: a pair of sheet separation members provided on both side edges of the case member having a pair of nail portions for separating the sheet in accordance with a sheet feed operation of the pair of feed roller members, the pair of sheet separation members being movable in a direction along which the sheets are stacked; first control means for controlling the stacked sheets in such a manner that the sheet located on the top of the stacked sheets is brought into contact with the pair of feed roller members; and second control means for controlling the first control means so as not to be operated in case a positional relationship between the sheet fed from the pair of feed roller members and the sheet feed means becomes a predetermined state.

According to another aspect of the invention, there is provided a sheet feeding device comprising a case member for holding a plurality of sheets in a stacked state, a pair of feed roller members located above the stacked sheets for feeding the sheet located on the top of the stacked sheets, and sheet feed means for further feeding the sheet fed from the pair of feed roller members, the sheet feeding device comprises: a pair of sheet separation members provided on both side edges of the case member having a pair of nail portions for separating the sheet in accordance with a sheet feed operation of said pair of feed roller members, the pair of sheet separation members being movable in a direction along which the sheets are stacked; first bias means for biasing the sheet located on the top of the stacked sheets with a first predetermined force in such a manner that the sheet is adapted to be brought into contact with the pair of feed roller members; second bias means for biasing the sheet with a second perdetermined force larger than the first predetermined force in an opposite direction of the first predetermined force; and control means for controlling the second bias means so as not to be operated in case that a positional relationship between the sheet fed from the pair of feed roller members and the sheet feed means becomes a predetermined state.

DESCRIPTION OF THE ACCOMPANYING DRAWINGS

DESCRIPTION OF THE EMBODIMENTS

Referring to Figures, an embodiment of the present invention is described.

Figure 1:
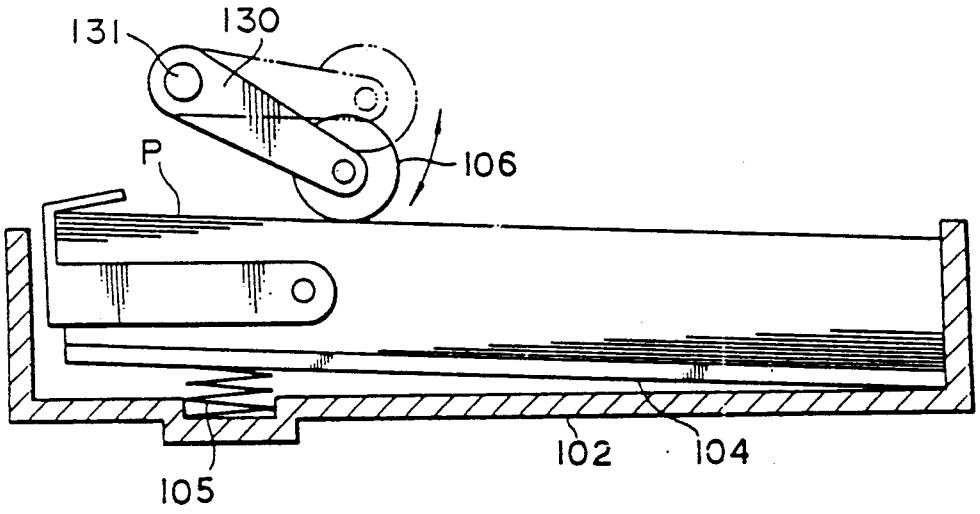
FIG. 1 (PRIOR ART)
FIG. 1 and FIG. 2 are sectional side views of conventional sheet feed rollers.
Figure 2:
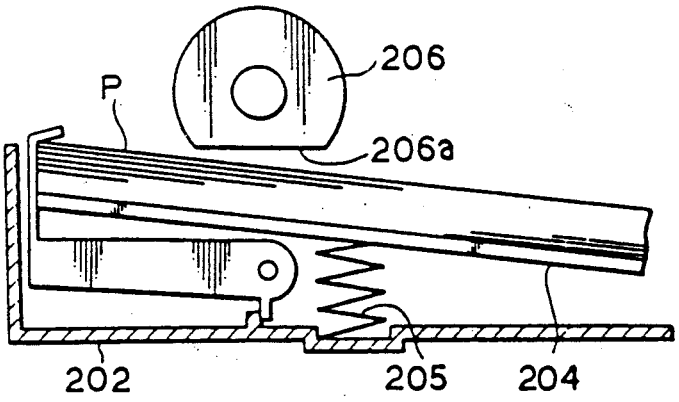
FIG. 2 (PRIOR ART)
Figure 3:
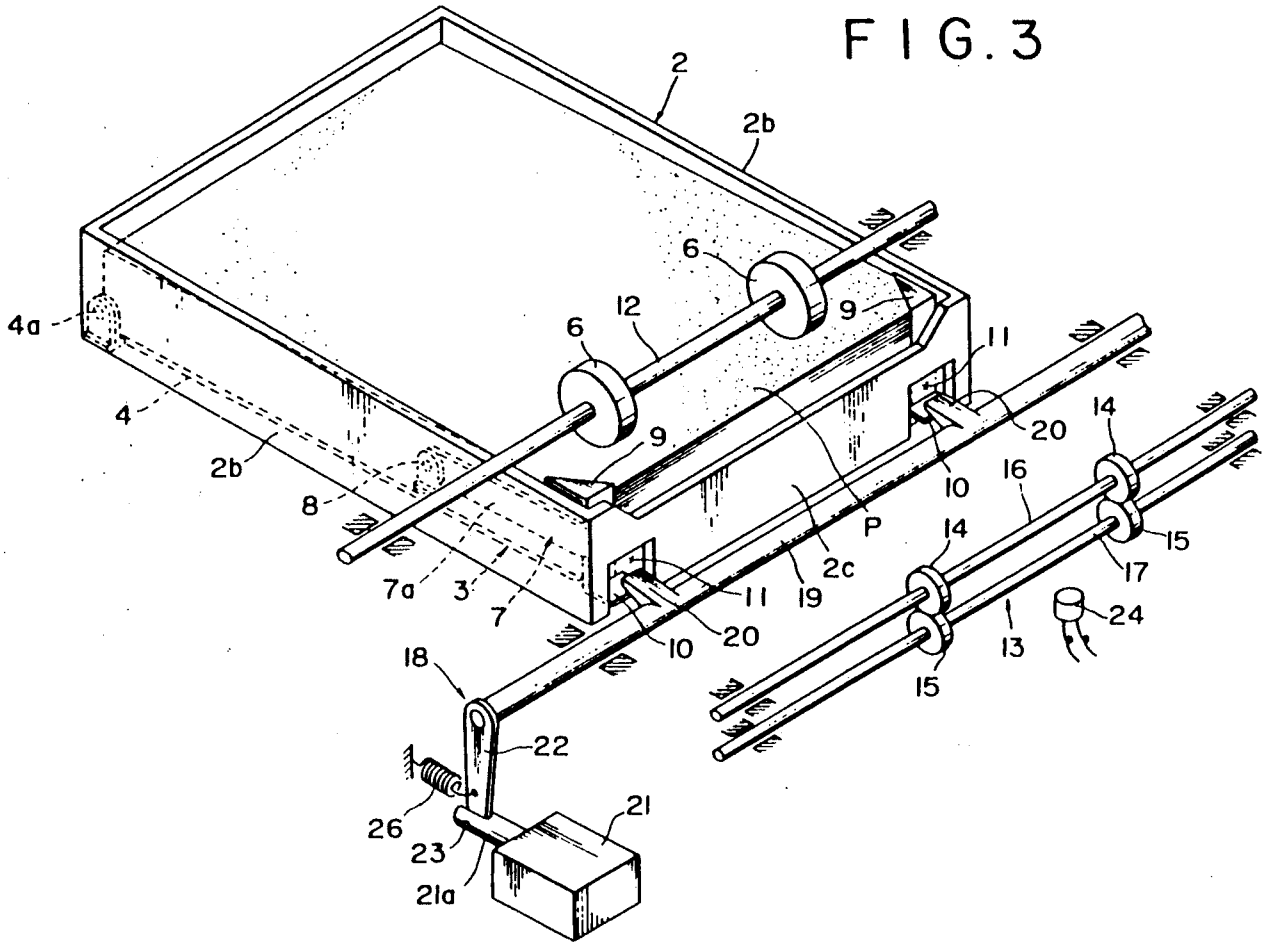
FIG. 3 is a perspective view of one embodiment of a sheet feeding device according to the inventions.
Figure 4:
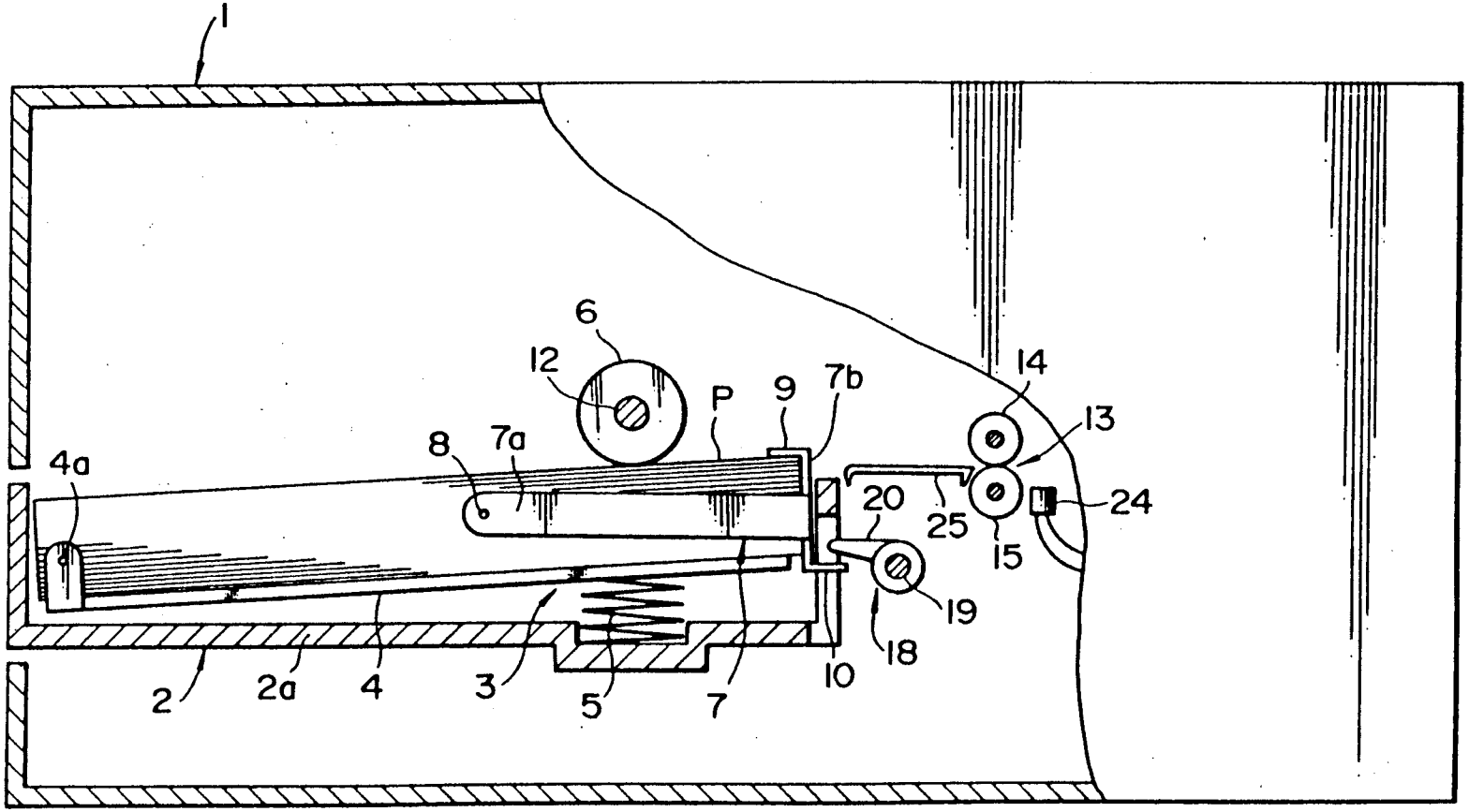
FIG. 4 is a sectional side view of the sheet feeding device of FIG. 1.
Figure 5:
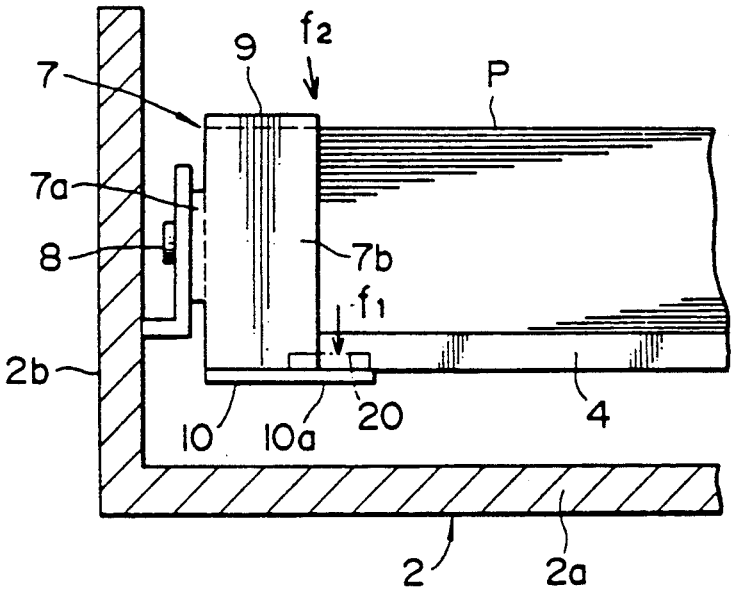
FIG. 5 is a front view showing a relationship between linking elements and depression elements of a sheet separation portion provided on a cassette case of sheet feeding device of FIG. 1.

In FIGS. 3 and 4 which show a perspective view and a sectional side view showing a sheet feed cassette embodying the present invention, mounted in a cassette housing portion of a printer main unit, respectively, a cassette case 2 is structured in a rectangular box shape where the upper side is open.

On a bottom plate 2*a* of the cassette case 2, a tension plate 4 (for supporting a plurality of stacked sheets P) is supported inclinably around pins 4*a*. The tension plate 4 is always pressed toward sheet feed rollers 6 by means of a spring 5. The spring 5 and tension plate 4 structure tension member 3 for pressing a bottom side of a bottom sheet of the stacked sheets P so as to cause the top sheet to touch the sheet feed rollers 6.

Figure 6:
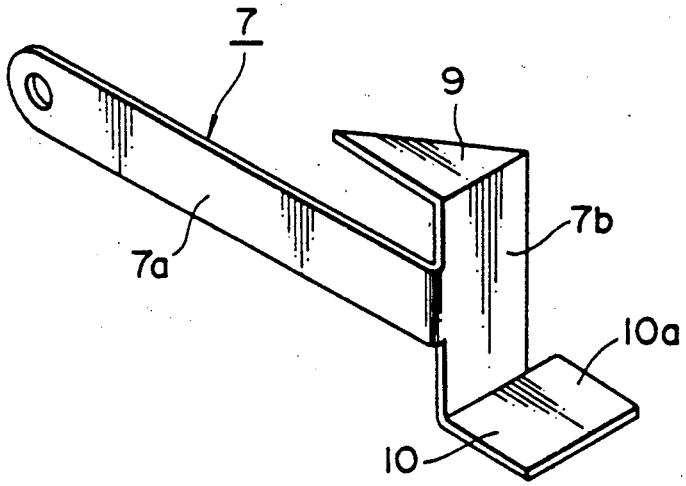
FIG. 6 is a perspective view showing the sheet separation portion of FIG. 5.

On both ends of the cassette case 2, a pair of left and right sheet separation portions 7 are provided. As shown in FIGS. 3 and 6, each of the sheet separation portions 7 mainly comprises an arm 7*a* which is located in parallel to a feed direction of the sheets P and whose rear end is supported inclinably to both side plates 2*b* around a pin 8 and a front plate 7*b* which is located at a front end of the arm 7*a* for touching the front end in the feed direction of the sheets P. At the upper ends of front plates 7*b*, separation nails 9 in a triangle shape which touch the top side of left and right corners of the front side in the feed direction of the sheet P stacked on the tension plate 4 are provided to separate the sheet. At the lower end of each front plate 7*b* a linking piece 10 is extended forwardly. The linking pieces 10 are inserted into opening windows 11 provided on both left and right sides of a front wall 2*c* in a manner so that they can be moved vertically. The linking pieces 10 are extended from the main unit for a predetermined length from the positions of the separation nails 9. The extended portions, referred to as linking portions 10*a*, touch push down pieces 20 described later.

On the other hand, as shown in FIGS. 3 and 4, in a printer main unit 1, on an upper side of the cassette housing portion thereof, a roller shaft 12 is rotatably supported. On the shaft of the roller shaft 12, a pair of left and right sheet feed rollers 6 touch the top sheet of the sheets P stacked in the cassette case 2 for feeding the sheet. The rollers 6 are rotatably provided so that they rotate in accordance with the roller shaft 12.

The printer main unit 1 is provided with a feed mechanism 13 on the down stream side of the sheet feed rollers 6; between the sheet feed rollers 6 and feed mechanism 13, a guide plate 25 is provided.

The feed mechanism 13 is composed of a drive and follower feed rollers 14 and 15. The feed rollers 14 and 15 are provided on the shafts of drive and follower roller shafts 16 and 17 supported rotatably at predetermined positions of the printer main unit 1, respectively. With the sheet feed operations of the sheet feed rollers 6, the top sheet of the sheets P is fed over the separation nails 9 and then sent to the feed mechanism 13. After that, the sheet is sent to a printer, not shown, by the feed mechanism 13, the sheet being intermittently sent for a length corresponding to the pitch of a printing line.

The peripheral speed of the sheet feed rollers 6 is faster than that of the drive feed roller 14 of the feed mechanism 13.

The printer main unit 1 is provided with push down means 18 for pushing down the sheet separation portions 7 when the top sheet of the sheets P is gotten over the separation nails 9 and then sent to the feed mechanism 13 by the sheet feed rollers 6.

Figure 7:
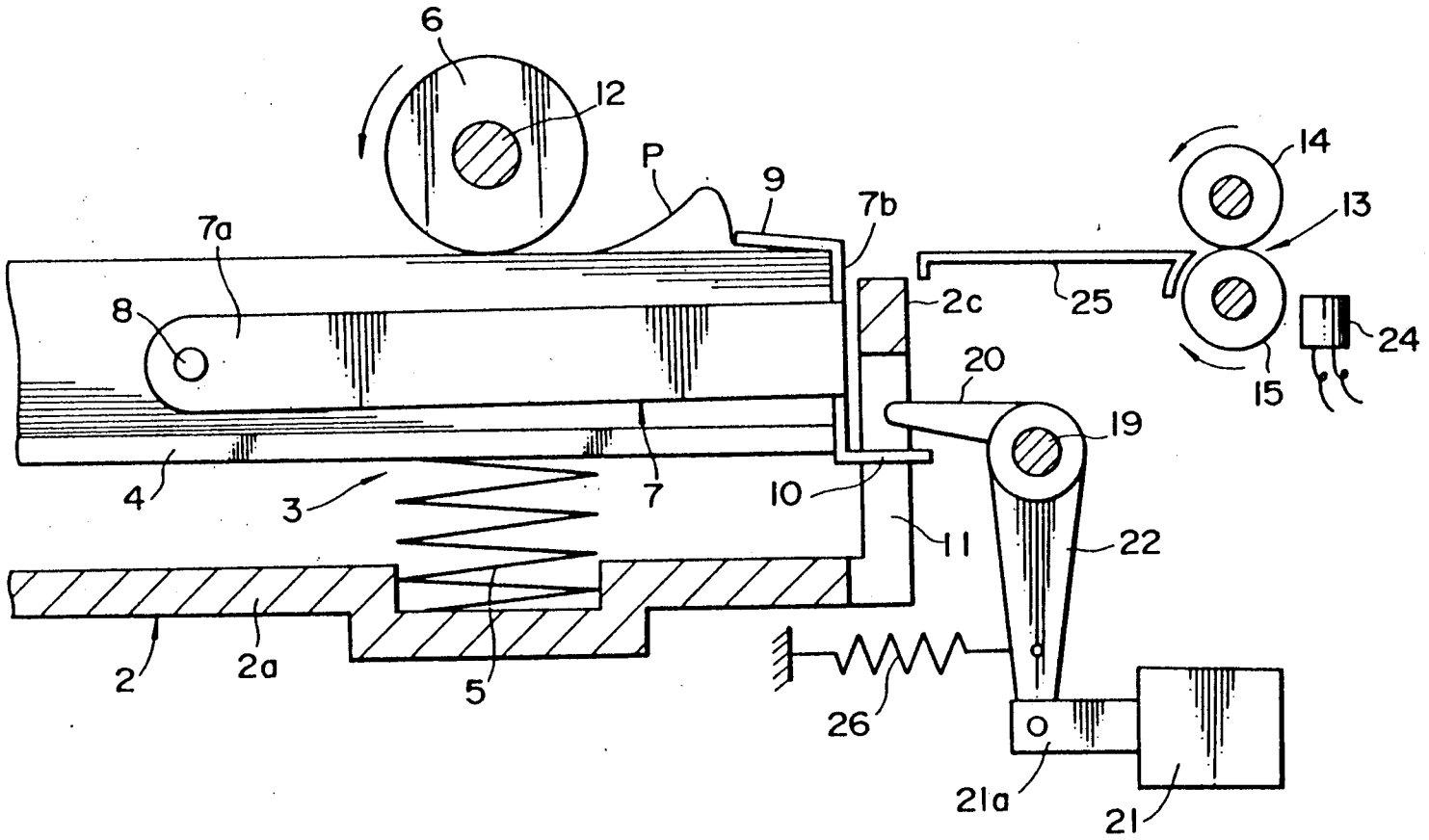
FIG. 7 is a sectional side view showing a beginning of a sheet feeding operations.

Referring to FIG. 3, the push down member 18 is described in the following. A push down shaft 19 is provided the front side of the cassette case 2 housed in the cassette housing portion and supported rotatably in the printer main unit 1. On a periphery of the push down shaft 19, push down pieces 20 are extended at positions where they can touch and separate to/from the top sides of the linking portions 10*a* of the linking pieces 10 of the sheet separation portions 7 on opposite sides of the top sides of the linking portions 10*a* and spaced a predetermined distance. By rotatably moving the push down shaft 19 in the push down direction, namely, counterclockwise in FIG. 7, the push down pieces 20 touch the linking portions 10*a* of the linking pieces 10. As the push down pieces 20 are further rotated, the sheet separation portions 7 are pushed down to predetermined positions against a tension of the tension member 3 as shown in FIG. 7, whereby the top sheet of the sheets P on the tension plate 4 of the tension member 3 is separated from the sheet feed rollers 6.

In this embodiment, the push down shaft 19 is caused to rotate by an electromagnetic solenoid 21 one end of a linking rod 22 is engaged to one end of the push down shaft 19; the other end of the linking rod 22 being pivoted by a plunger 21*a* of the electromagnetic solenoid 21 on a pin 23. Adjacent to the feed mechanism 13 (on down stream side), a photo-electric type sheet sensor 24 is provided to cause the electromagnetic solenoid 21 to work in accordance with a sheet detection signal from the sensor 24.

This embodiment is structured as describe above. Thus, as shown in FIG. 7, the top sheet of the sheets P touches the sheet feed rollers 6 as a result of the bias of tension plate 4 which is biased by the spring 5. The roller shaft 12 is driven rotatably by a sheet feed motor, not shown, as a drive source, whereby the sheet feed rollers 6 are rotated in the sheet feed direction along with the roller shaft 12, and the sheet feed rollers 6 feed the top sheet of the sheets P. At the time, the left and right ends on the front side of the top sheet are bent in an arch shape by the separation nails 9 of the sheet separation portions 7 and then fed over the separation nails 9. The top sheet of the sheets P is guided by the guide plate 25 and sent to the feed mechanism 13 on the down stream side.

When the top sheet arrives at a position between the drive feed roller 14 and the follower feed roller 15 of the feed mechanism 13, it is sent to the printer, not shown, by the sheet feed operations of the rollers 14 and 15.

Figure 8:
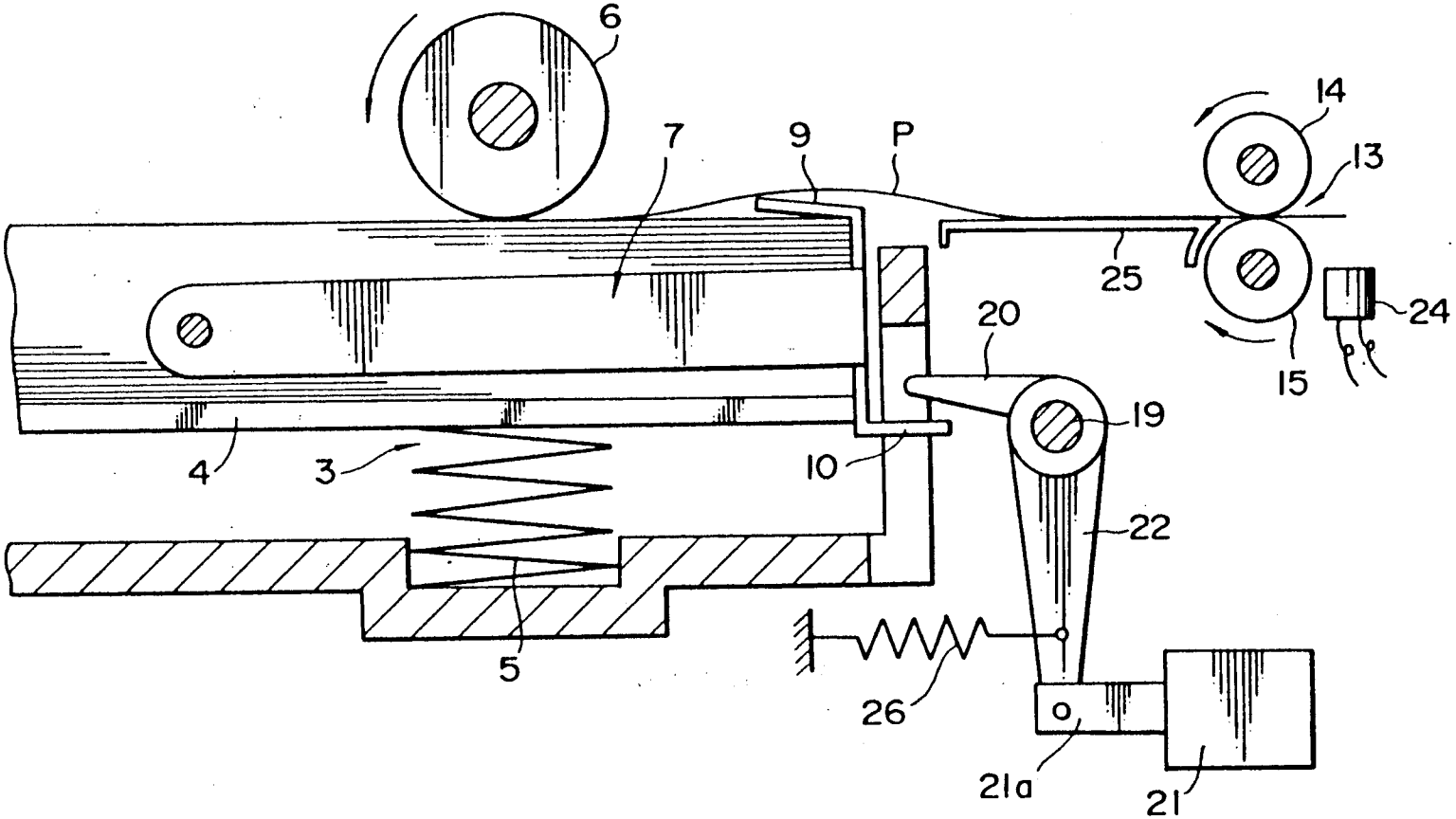
FIG. 8 is a sectional side view of the sheet feeding device when a sheet has been sent to a feed mechanism sequentially located to the pair of sheet feed rollers.

When the front end of the sheet P is sent a predetermined distance by the feed mechanism 13 as shown in FIG. 8, the sent sheet is detected by the sheet sensor 24. In accordance with the sheet detection signal from the sheet sensor 24, the electromagnetic solenoid 21 is activated, which draws in the plunger 21*a* against a return spring 26.

Figure 9:
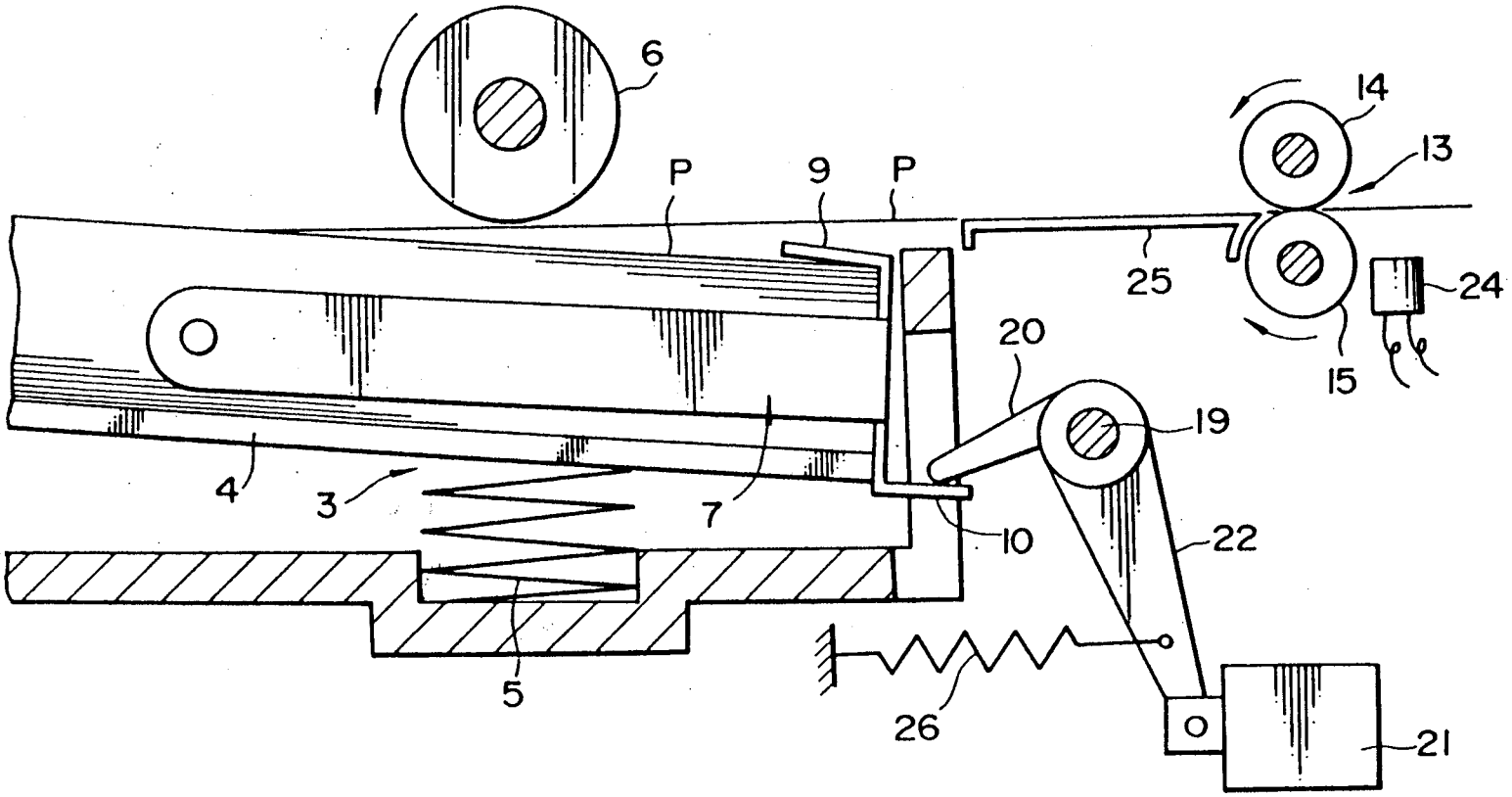
FIG. 9 is a sectional side view of the sheet feeding device when the stacked sheet are separated from the pair of sheet feed rollers.

When the plunger 21*a* is drawn in, the push down shaft 19 is moved rotated through the linking rod 22. The push down pieces 20 which are rotated along with the push down shaft 19 touch the linking portions 10*a* of the linking pieces 10, thereby pushing down a predetermined stroke against the tension of the tension member 3 as shown in FIG. 9. Thus, since the sheet is separated from the paper feed rollers 6 without touching thereto, the sheet is free from a load of a contacting friction caused by the sheet feed rollers 6. Consequently, even if sheet feed rollers whose diameters are comparatively small were used, the feed mechanism 13 could provide an independent, highly precise sheet feed operation.

In addition, in the above embodiment, since the linking pieces 10 of the sheet separation portions 7 are extended more inwardly than the positions of the separation nails 9 of the sheet separation portions 7 and the extended portion referred to as the linking portions 10*a* are pushed down by the push down pieces 20, the push down force of the sheet separation portions 7 caused by the push down pieces 20 is considered to be divided into two components: one is a force $f_1$ which causes the separation nails 9 of the paper separation portions 7 to push down to the top sheets of the psheets P and the other is a force $f_2$ which urges the separation nails 9 against the top sheet of the sheets P. Therefore, the sheet separation portions 7 can be securely pushed down for a predetermined stroke without the separation nails 9 inclined in the direction where they are deviated from the top side of the sheets P.

Figure 10:
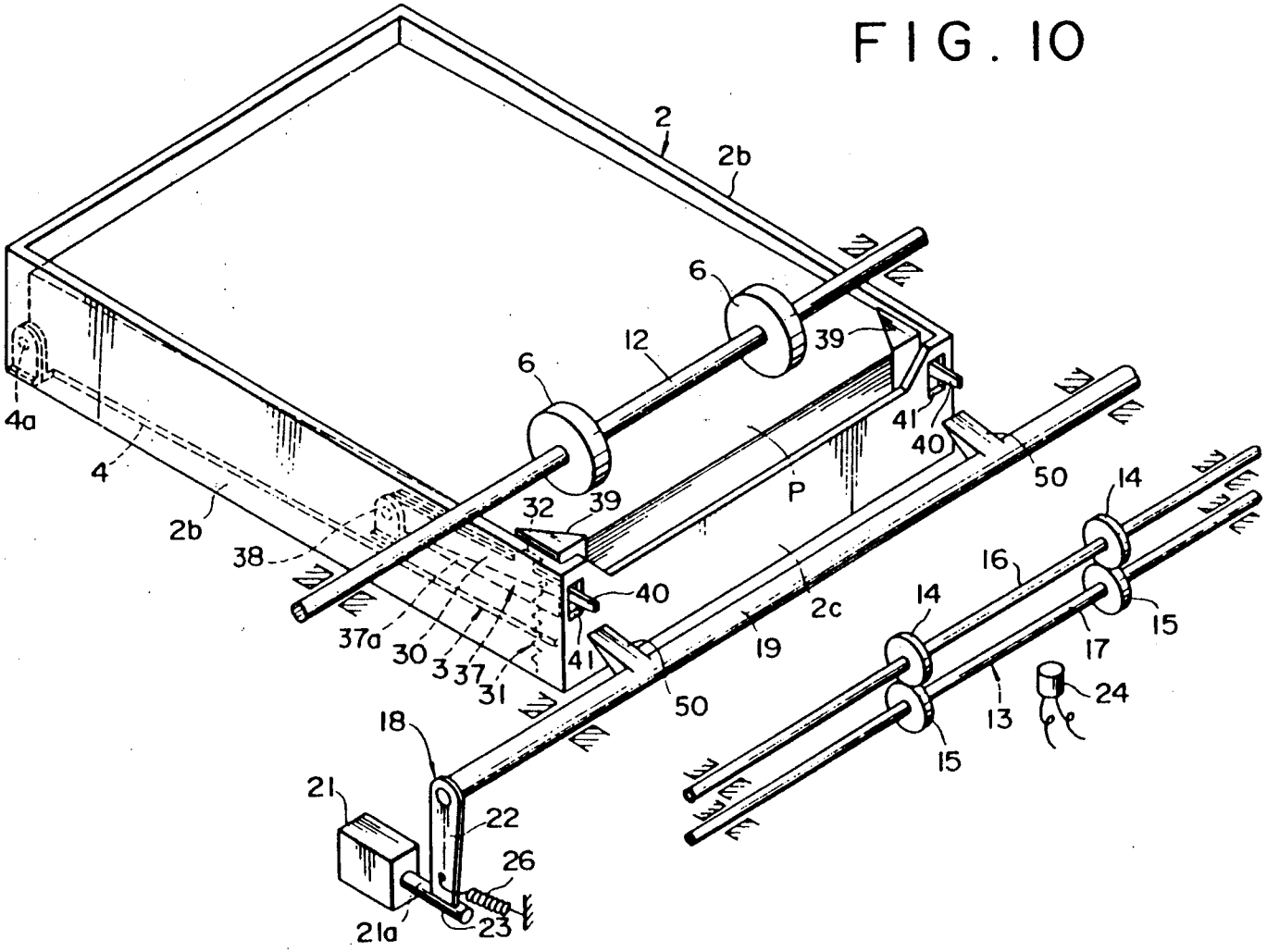
FIG. 10 is a perspective view of an another embodiment of a sheet feeding device according to the invention.
Figure 11:
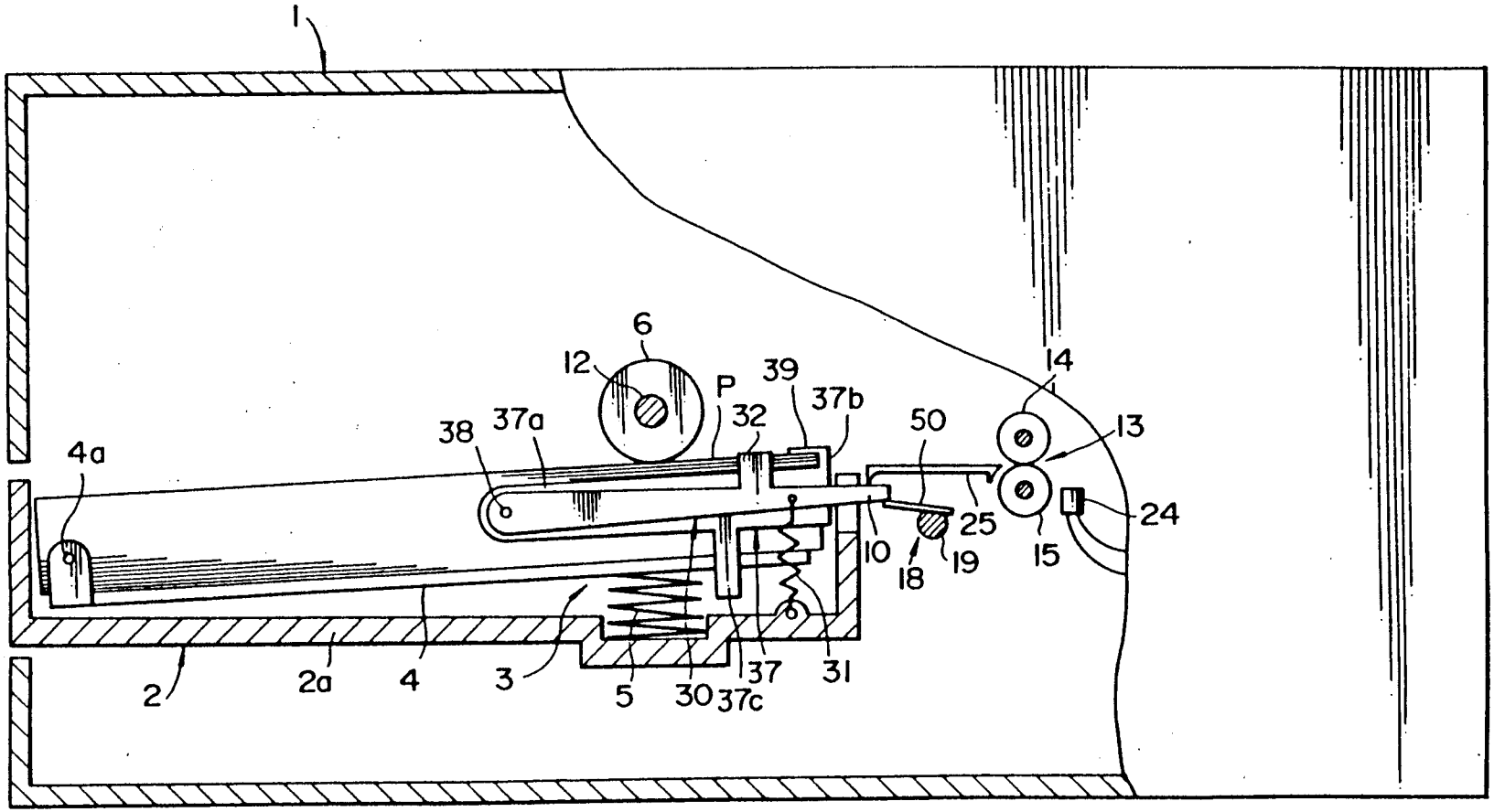
FIG. 11 is a sectional side view of the sheet feeding device of FIG. 10.

In FIGS. 10 and 11 which show a perspective view and a sectional side view of another embodiment of the present invention similar to the FIGS. 3 and 4 embodiment. FIG. 10 shows where the cassette case is attached and a paper feed operation is requested.

Figure 12:
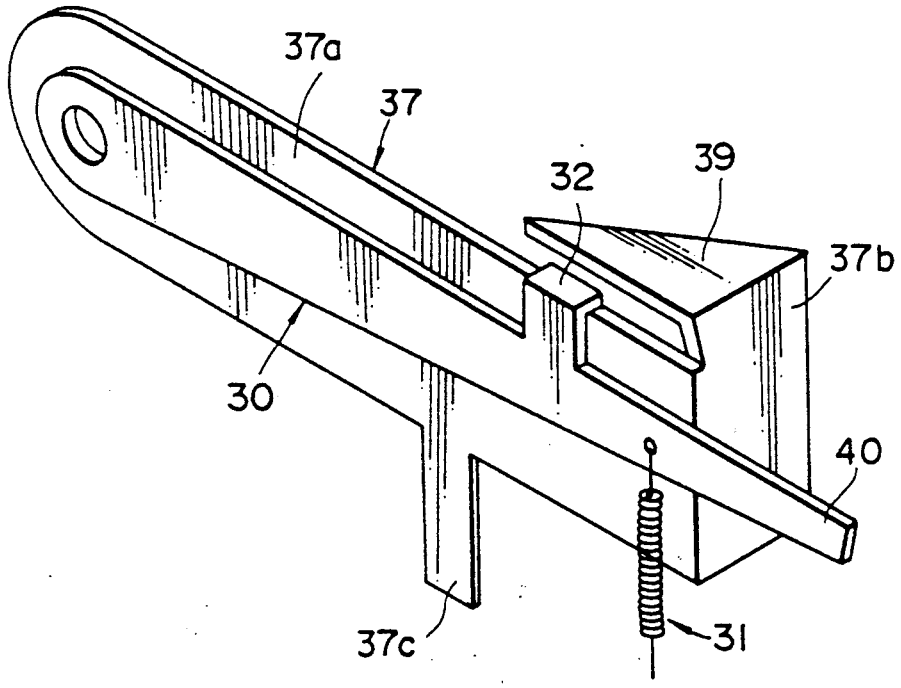
FIG. 12 is a perspective view showing a sheet separation portion provided on a cassette case of sheet feeding device of FIG. 10.

In this embodiment, as shown in FIGS. 10 and 12, each of the sheet separation portions 37 chiefly comprises an arm 37*a* which is located in parallel to the feed direction along which the sheet located on the top of the sheets P is fed, and whose rear end is supported inclinably to both side plates 2*b* around a pin 38 and a front plate 37*b* which is located at a front end of the arm 37*a* for supportably touching the front end in the feed direction of the sheet. At the upper end of each front plate 37*b*, a separation nail 9 of a triangle shape is provided to touch the top side left and right corners of the front side of the sheets P stacked on the tension plate 4 to separate the top sheet. In addition, at the lower end of each of sheet separation portions 37, a touching piece 37*c* is downwardly extended.

The left and right push down portions 30 are provided outside the sheet separation portions 37 so as to inclinably move the push down portions 30 around the pin 38. The push down portions 30 are biased toward the base plate 2a of the cassette case 2 by tension springs 31 which have stronger tensions than those of the springs 5. At upper ends of the push down portions 30, engagement portions 32 are provided which can be brought into engagement with the arm portions 37a of the sheet separation portions. At the front ends of the push down portions 30, linking pieces 40 are forwardly extended. The linking pieces 40 are inserted into opening windows 41 provided on both left and right sides of a front wall 2c in the manner that they can be moved vertically, so as to engage them with push up pieces 50 described later.

Figure 13:
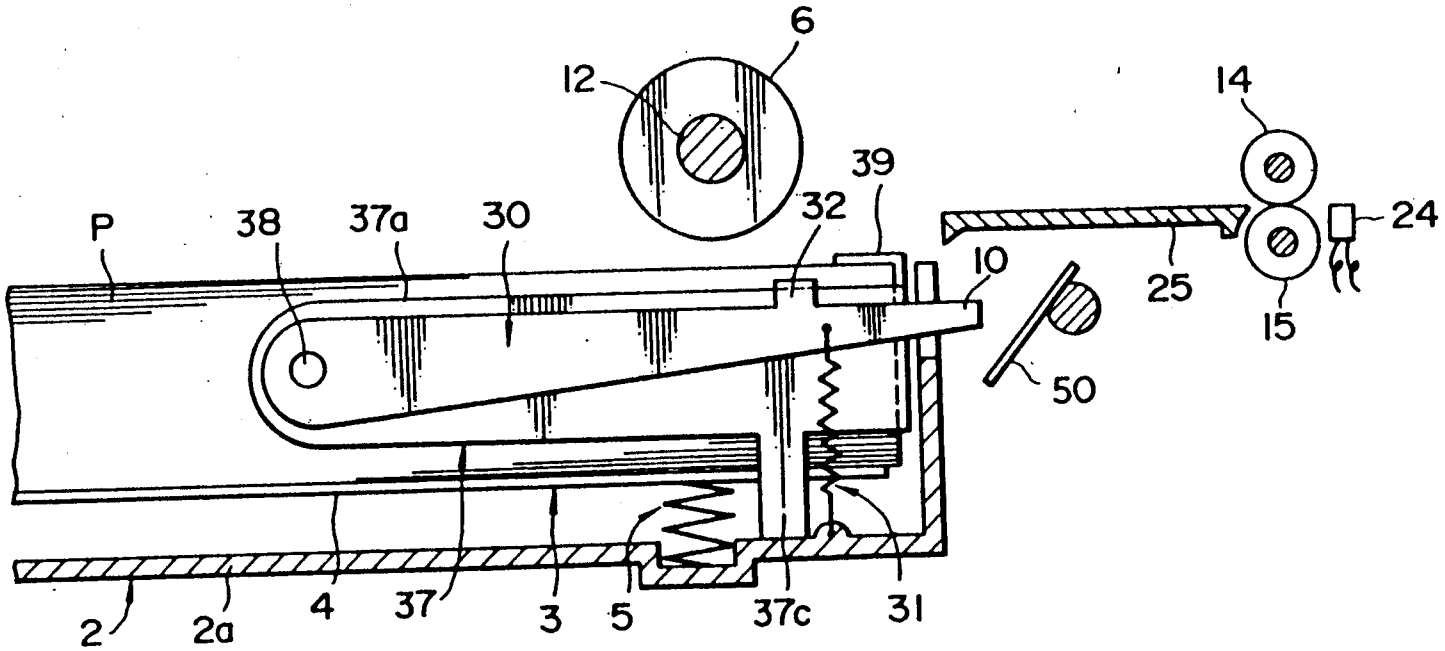
FIG. 13 is a sectional side view showing a state of sorrounding portion of the cassette case when a push up element is located is a non work portion.

As shown in FIG. 13, the sheet separation portions 37 are usually pushed down by the push down portions 30. Ends of the touching pieces 37c are fixed at positions where they touch the bottom plate 2a of the cassette case 2. Thus, the top sheet is fixed at a position where sheet separation portions 37 having the separation nails 39 are pressed as shown in FIG. 13, namely, a position where the sheet is separated from the sheet feed rollers 6 described later. In the meantime, a pair of sheet feed rollers 6 for feeding the top sheet located on the sheets P, a feed mechanism 13 for futher feeding the sheet fed from the rollers 6 and a guide plate 25 for guiding the sheet from the rollers 6 to the feed mechanism 13 are respectively located, in the same manner as in the preceding embodiment.

The printer main unit 1 is provided with push up member 18 which pushes up the push down portions 30 when the printer main unit 1 issues a sheet feed request.

Figure 14:
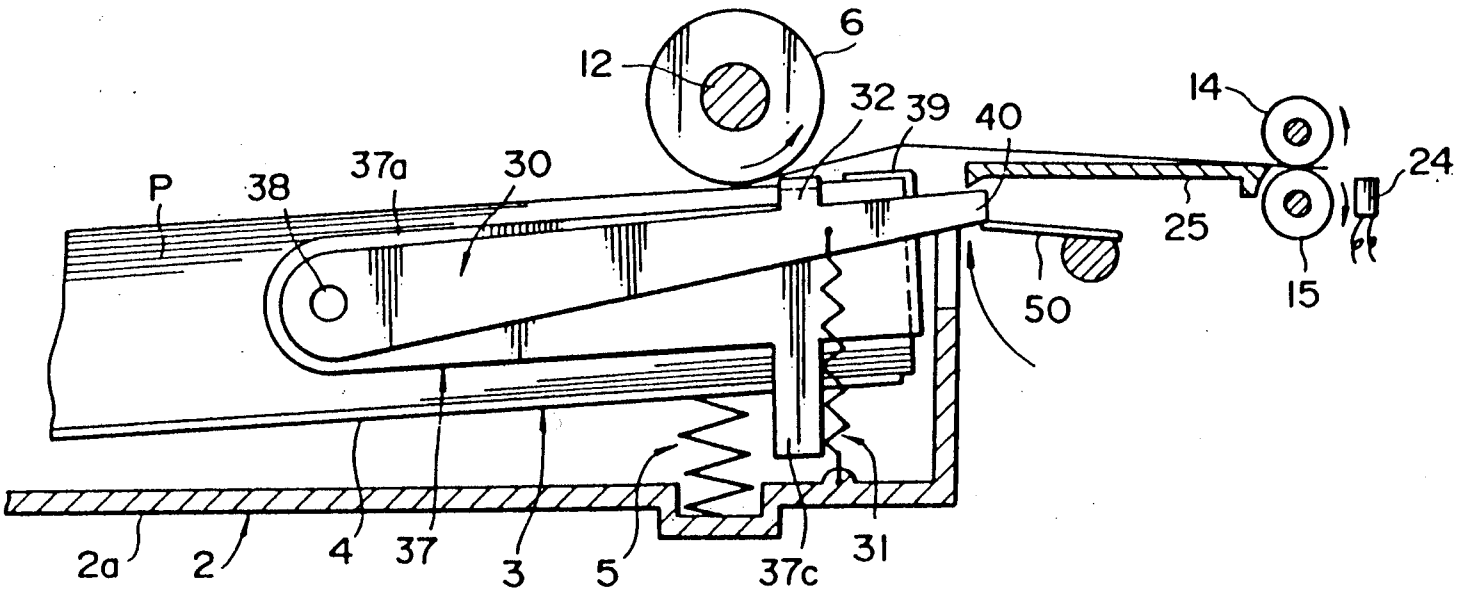
FIG. 14 is a sectional side view showing a state of sorrounding portions of the cassette case when a push up element is located in a work position.

Referring to FIG. 10, the push up member 18 is described in the following. On the front side of the cassette case 2 housed in the cassette housing portion, a push up shaft 19 is rotatably supported in the printer main unit 1. On the periphery of the push up shaft 19, push up pieces 50 which can touch the linking pieces 40 of the push down portions 30 are extendedly provided. The push up pieces 50 are movable between a work position shown in FIG. 14 and a non-work position shown in FIG. 13 by a rotatable motion of the push up shaft 19. When the push up pieces 50 are moved from the non-work position shown in FIG. 13 to the work position shown in FIG. 14 by the rotatable motion of the push up shaft 19, the push up pieces 50 engage the linking pieces 40, thereby pushing up the push down portions 30 to predetermined positions against a tension of the tension springs 31. At the time, since the engagement between the engagement portions 32 of the push down portions 30 and the sheet separation portions 37 is released, the sheet separation portions 37 and the sheets P are tensioned upwardly by the tension member 3, thereby touching the top sheet to the sheet feed rollers 6.

In a no-sheet feed state which includes cassette case attaching and detaching states, the push up pieces 50 return to the non-work positions. After the printer main unit 1 issues a sheet feed request until the sheet is sent to the sheet feed mechanism 13, the push up pieces 50 are placed in the work position.

In this embodiment, the push up shaft 19 is rotatably moved in a push up direction by an electromagnetic solenoid 21 which is a drive source thereof. One end of the push up shaft 19 is engaged to one end of a linking rod 22, the other end of the linking rod 22 being pivoted by a plunger 21a of the electromagnetic solenoid 21 and a pin 23.

The electromagnetic solenoid 21 is activated by a sheet feed request signal from the printer main unit 1 and deactivated by a sheet detection signal from a photoelectric type sheet sensor 24 provided on the down stream side of the feed mechanism 13.

The embodiment of the present invention is structured as described above. When the cassette case 2 is attached to the cassette housing portion of the printer main unit 1, since the push up pieces 50 in the non-work position do not touch the linking pieces 40 of the push down portions, the push down portions 30 are tensioned in the push down direction by the tension springs 31, the sheet separation portions 37 being pushed down by engagements of the engagement portions 32 of the push down portions 30 thereto. Since the separation nails 39 provided together with the sheet separation portions 37 are pushed down, the sheet is pushed down to a predetermined position, namely, the position where the touching pieces 37c touch the bottom plate 2a, thereby separating the top sheet of sheets being stacked from the sheet feed rollers 6 of the printer main unit 1. Therefore, when the cassette case 2 is attached, the top sheet does not touch the sheet feed rollers 6.

When the printer main unit 1 issues a sheet feed request after the cassette case 2 has been attached, the electromagnetic solenoid 21 is activated, so that the plunger 21a is drawn in against a tension of a return spring 26. When the plunger 21a is drawn in, the push up shaft 19 is rotatably moved in the push up direction though the linking rods 22. At the time, the push up pieces 50 which are rotatably moved together with the push up shaft 19 are placed in the work position, thereby engaging the push down portions 30 to the linking pieces 40 so as to push up the push down portions 30 against tensions of the tension springs 31 for a predetermined stroke shown in FIG. 14. At the time, the engagement between the engagement portions 32 of the push down portions 30 and the sheet separation portions 37 is released, whereby the sheet separation portions 37 with the sheet separation nails 39 are pushed up in the direction of the sheet feed rollers 6 by the tension of the tension member 3 until the top sheet touches the sheet feed rollers 6.

In this state, the roller shaft 12 is rotatably driven by a sheet feed motor, not shown, which is a drive source. At the time, the left and right corners of the front end of the top sheet are bent by the pair of separation nails 39 and pass over. After that, the sheet which is guided by the guide plate 25 is sent to the feed mechanism 13 on the down stream side.

When the sheet arrives at a position between a drive and follower feed rollers 14 and 15 of the feed mechanism 13, it is sent to the printing apparatus, not shown, by a sheet feed operation thereof.

When the front end of the sheet is sent for a predetermined distance by the feed mechanism 13 it is detected by the sheet sensor 24 and a detection signal is sent out by the sheet sensor 24. In accordance with the signal, the rotations of the sheet feed rollers 6 are stopped and the electromagnetic solenoid 21 is deactivated, whereby the plunger 21a is returned by the tension of the return spring 26. At the time, since the push up pieces 50 are placed in the non-work position, the push down portions 30 are returned back to positions shown in FIG. 13 by the tensions of the tension springs 31. The sheet separation portions 37 which are engaged to the engagement portions 32 of the push down portions 30 are pushed down along with the separation nails 39 and the sheet which touches the separation nails 39 is pushed down, thereby separating the top sheet from the sheet feed rollers 6.

In this state, since the feed mechanism 13 sends the top sheet in a pitch required by the printer main unit 1, the pitch feeding is free from a contact friction caused by the sheet feed rollers 6, thereby allowing an independent, highly precise, fine sheet feeding by the feed mechanism 13 and/or a sheet feed mechanism on the down stream side.

When a sheet has been fed and the printing operations are executed on the surface of the sheet, the printer main unit 1 issues a next sheet feed request, whereby the sheet feed operation described above again takes place.

When the cassette case 2 is detached, the push up pieces 50 are placed in the non-work position, so that the sheet feed rollers 6 do not touch the sheet located on the top of the stacked sheets P whereby the cassette case 2 can be smoothly detached.

As described above, in this embodiment, when the cassette case 2 in which the sheets P is stacked is attached and detached to and from the printer main unit 1, the top sheet does not touch the sheet feed rollers 6. In addition, in the sheet feed operation, when the sheet is sent from the sheet feed rollers 6 to the feed mechanism 13 on the down stream side, the sheet feed rollers 6 do not touch the sheet, whereby the feed mechanism 13 allows a high precision sheet feed operation.

In addition, in this embodiment, since the amount of stroke for rotating the push up pieces 50 is constant irrespective of the number of sheets P, the apparatus can be simply controlled. Moreover, the working time of the electromagnetic solenoid which is a power source for rotatably driving the push up pieces 50 is a very short time of which the sheet is sent from the sheet feed rollers 6 to the feed mechanism 13, thereby saving the power consumption and prolonging the life of the electromagnetic solenoid.

What is claimed is:

1. A sheet feeding device comprising a case member for holding a plurality of sheets in a stacked state, a pair of feed roller members located above the stacked sheets for feeding the sheet located on the top of the stacked sheets, and sheet feed means for further feeding the sheet fed from said pair of feed roller members, said sheet feeding device comprises:

a pair of sheet separation members each provided at a side edge of said case member and each having a nail portion for separating the sheet in accordance with a sheet feed operation of said pair of feed roller members, said pair of sheet separation members being movable in a direction along which the sheets are stacked;

first control means for controlling the stacked sheets in such a manner that the sheet located on the top of the stacked sheets is brought into contact with said pair of feed roller members; and second control means for controlling said first control means so as not to be operated in case a positional relationship between the sheet fed from said pair of feed roller members and said sheet feed means becomes a predetermined state.

2. The sheet feeding device according to claim 1 wherein said sheet feed means comprises another pair of feed roller members for feeding the sheet fed from said pair of roller members, and wherein said predetermined state is that a predetermined length of the sheet is fed by said another pair of feed roller members.

3. The sheet feeding device according to claim 1 wherein said first control means comprises a spring member for pressing the bottom of said case member holding the stacked sheets in a vertical direction, and wherein said second control means comprises depress members for depressing said case member against a force of said spring member and detect means for detecting said predetermined state.

4. The sheet feeding device acording to claim 3 wherein said detect means comprises an optical sensor for detecting a leading end of the sheet having been fed by said another pair of feed roller members.

5. The sheet feeding device according to claim 3 wherein said depress members are so controlled not to be operated in case that said predetermined state is not detected by said detect means.

6. The sheet feeding device according to claim 3 wherein said depress members are further controlled so as not to be operated after the elapsing of a predetermined period of time after a detection of said predetermined state.

7. The sheet feeding device according to claim 3 wherein said depress members comprise a pair of depress elements for depressing a pair of contact elements provided on said case member.

8. The sheet feeding device according to claim 7 wherein said pair of contact elements are respectively provided on said pair of sheet separation members.

9. A sheet feeding device comprising a case member for holding a plurality of sheets in a stacked state, a pair of feed roller members located above the stacked sheets for feeding the sheet located on the top of the stacked sheets, and sheet feed means for further feeding the sheet fed from said pair of feed roller members, said sheet feeding device comprises:

a pair of sheet separation members each provided at a side edge of said case member and each having a nail portion for separating the sheet in accordance with a sheet feed operation of said pair of feed roller members, said pair of sheet separation members being movable in a direction along which the sheets are stacked;

first bias means for biasing the sheet located on the top of the stacked sheets in a first predetermined force in such a manner that said sheet is adapted to be brought into contact with said pair of feed roller members;

second bias means for biasing said sheet in a second predetermined force larger than said first predetermined force in an opposite direction of said first predetermined force; and control means for controlling said second bias means so as not to be operated in case that a positional relationship between the sheet fed from said pair of feed roller members and said sheet feed means becomes a predetermined state.

10. The sheet feeding device according to claim 9 wherein said control means comprises a release member for releasing a second predetermined force by said second bias means in said predetermined state, adapted to be movable between a first predetermined position at which said second predetermined force is released and a second predetermined podition at which said second predetermined force is not released, and a detect means for detecting said predetermined state.

11. The sheet feeding device according to claim 10 wherein said predetermined state comprises an absence of a sheet in said sheet feed means.

12. The sheet feeding device according to claim 10 wherein said release member is moved to said second predetermined positions in case that the sheet having been located on the top of the stacked sheets is reached said sheet feed means.

13. The sheet feeding device according to claim 10 wherein said sheet feed means comprises an another pair of feed roller members for further feeding the sheet fed from said pair of feed roller members, and wherein said detect menas comprises an optical sensor for detecting a leading end of the sheet having been fed by said another pair of feed roller members.

14. The sheet feeding device according to claim 13 wherein said release member is moved to said second predetermined position in case that said optical sensor detects a leading end of the sheet fed from said another pair of feed roller members.

15. The sheet feeding device according to claim 10 wherein said first bias means comprises a first spring member for pressing the bottom of said case member holding the stacked sheets in a vertical direction, wherein said second bias means comprises a second spring member for generating said second predetermined force, and wherein said release member comprises a pair of press up elements adapted to be brought into and out of contact with a predetermined portion of said case member in accordance with a result of a detect operation executed by said detect means, said second predetermined force being released in case that said pair of press up elements are brought into contact with said predetermined portions of said case member.

16. The sheet feeding device according to claim 15 wherein said predetermined portion comprises a pair of contact elements provided on said pair of sheet separation members.

* * * * *